United States Patent [19]

Melchior

[11] 4,162,662

[45] Jul. 31, 1979

[54] TWO-STROKE INTERNAL COMBUSTION ENGINES

[76] Inventor: Jean Melchior, 66 Boulevard Maurice-Barrès, 92200 Neuilly-sur-Seine, France

[21] Appl. No.: 758,997

[22] Filed: Jan. 13, 1977

[30] Foreign Application Priority Data

Jan. 15, 1976 [FR] France ..... 76 00971

[51] Int. Cl.[2] ..... F02B 75/02; F02B 77/00

[52] U.S. Cl. ..... 123/65 VD; 123/65 BA; 123/188 M; 123/195 H; 123/198 P

[58] Field of Search ..... 123/65 BA, 65 B, 65 VD, 123/73 AF, 73 S, 188 S, 188 AF, 188 M, 188 VA, 193 H, 193 CH, 196 CP, 198 P, 90.24, 90.14; 92/261

[56] References Cited

U.S. PATENT DOCUMENTS

| | | | |
|---|---|---|---|
| 1,758,429 | 5/1930 | Cory | 123/65 VD |
| 1,904,680 | 4/1933 | Ferry | 123/65 BA |
| 2,005,821 | 6/1935 | Buchi | 123/65 VD |
| 2,136,070 | 11/1938 | Bohemuller | 123/65 VD |
| 2,280,839 | 4/1942 | Wallinger | 123/65 BA |
| 2,429,732 | 11/1947 | Roos | 123/198 P |
| 2,456,272 | 12/1948 | Gregory | 123/193 CH |
| 2,719,516 | 10/1955 | Clark | 123/90.14 |
| 2,768,617 | 10/1956 | Tierney et al. | 123/188 VA |
| 2,782,773 | 2/1957 | Stone | 123/198 P |
| 3,120,221 | 2/1964 | Lyons | 123/90.14 |
| 3,557,766 | 1/1971 | Stark | 123/188 M |
| 3,722,483 | 3/1973 | Overby | 123/90.14 |
| 3,903,854 | 9/1975 | Shelton | 123/73 S |

FOREIGN PATENT DOCUMENTS

| | | | |
|---|---|---|---|
| 165232 | 2/1950 | Fed. Rep. of Germany | 123/188 S |
| 2061930 | 7/1972 | Fed. Rep. of Germany | 123/193 H |

*Primary Examiner*—Charles J. Myhre
*Assistant Examiner*—David D. Reynolds
*Attorney, Agent, or Firm*—Barnes, Kisselle, Raisch & Choate

[57] ABSTRACT

The cylinders of a supercharged two-stroke internal combustion engine have valves, intake and exhaust pipes and a cylinder head constructed for air to be directed from the intake pipe toward the piston along the wall of the cylinders upon opening of the valves and to scavenge the combustion chamber without substantial direct flow of air from the intake pipe to the exhaust pipe along the cylinder head.

14 Claims, 5 Drawing Figures

TWO-STROKE INTERNAL COMBUSTION ENGINES

BACKGROUND OF THE DISCLOSURE AND SUMMARY OF THE INVENTION

This invention relates to supercharged two-stroke internal combustion engines and particularly, although not exclusively, to engines of this type ignited by compression or Diesel engines.

Two-stroke engines require scavenging means for removing the burned gases in the combustion chamber or chambers.

One of the scavenging systems currently in use, which may be described as a system of scavenging "from below" makes use of intake and exhaust ports in the cylinder wall, which are opened by the piston when the latter is close to its lower dead centre. The exhaust ports are generally longer than the intake ports so that they are the first to be uncovered when the piston approaches its lower dead centre. This solution requires a high stroke/bore ratio for the engine so that the ports offer a sufficient passage to the gases. In practice, such an engine has a stroke/bore ratio of at least 1.2. The useful stroke (during which the cylinder is separated from the intake and exhaust pipes) may be, for example, about 0.6 time the total piston stroke in the case of high speed engines.

Another known scavenging system, which may be described as "unicurrent", comprises intake ports and one or more exhaust valves. The "permeability" of the ports in this case increases with the stroke/bore ratio while the "permeability" of the valves decreases as this ratio increases. A compromise solution is therefore arrived at, amounting to a stroke/bore ratio of about 1. The useful stroke is higher than in the preceding case, since there is no exhaust port. It is generally about 0.8 time the total stroke. The scavenging phase, during which the intake ports are open, generally extends over an angle of rotation of the crankshaft of 120° about the lower dead centre.

Both solutions have the disadvantage of requiring a relatively high stroke/bore ratio. At the most, the engine may be "square" (i.e. with a stroke/bore ratio equal to unity). An analysis of the structure and operation of two-stroke engines shows that it would be advantageous to reduce the stroke/bore ratio to the lowest possible value, that is to say to design a "super-square" engine. In particular, at a given linear piston velocity, a super-square engine runs faster and develops more power than another engine of the same cubic capacity. Two-stroke engines having a conventional scavenging system are practically impossible to design as super-square engines because of the length of dead stroke required for closing the ports.

In addition, using ports for scavenging results in complexity of the cylinder jacket. Moreover, the passage of the piston rings in front of the ports makes design of the rings difficult. Lastly, it is necessary to provide one or more additional packing rings at the bottom of the piston skirt to ensure a tight seal between the crank case and the intake manifold. This results in a longer and therefore heavier piston and a longer and more bulky cylinder sleeve.

Any reduction in the stroke/bore ratio would also enable the diameter of the crank case to be reduced, due to the shorter piston stroke for a given cubic capacity.

Another disadvantage resides in the difficulty of lubricating a cylinder jacket formed with apertures without excessive consumption of oil and deposit of carbon at the exhaust ports.

In another prior art two-stroke engine (German Pat. No. 905,687), there is provided an exhaust valve located in the cylinder head and a lateral intake valve: in such an engine, satisfactory scavenging cannot be achieved.

It is an object of the invention to provide a supercharged two-stroke engine in which the limitations mentioned above are considerably attenuated, and which is appropriately scavenged even if super-square.

According to one aspect of the invention, there is provided an engine having at least a cylinder block and a cylinder head cooperating with at least one piston reciprocably received in a cylinder formed in said cylinder block to define at least one expansible combustion chamber, at least one intake valve slidably received in said cylinder head and cooperating with an intake valve seat to control airflow from an intake pipe into said chamber; at least one exhaust valve slidably received in said cylinder head and cooperating with an exhaust valve seat to control gas flow from said combustion chamber to an exhaust pipe; and means for operating said intake and exhaust valves in proper time sequence with the displacement of said piston, whereby both said valves are open while the piston is at its bottom dead centre, said intake valve, intake pipe and cylinder head being constructed for air to be directed toward the piston and substantially parallel to the wall of said cylinder upon opening of the intake valve and to scavenge the chamber without substantial direct flow of air from the intake pipe to the exhaust pipe along the cylinder head.

The intake pipe (and generally preferably the exhaust pipe as well) is typically directed substantially parallel to the direction of movement of the piston, at least in a portion thereof close to the seat of said intake valve and long enough to impress a direction of flow to the air admitted into the chamber.

In other words, the cylinder head is formed with a deflecting surface between said intake valve and exhaust valve for substantially preventing direct flow of air from the intake pipe to the exhaust pipe upon simultaneous opening of both valves and for directing the airflow admitted around said intake valve toward the piston along the cylinder wall.

The valves are advantageously disposed symmetrically in the cylinder head. In particular, the valves may be directed at an angle of about 45° from the axis of the chamber, the valve heads or disks moving to and from valve seats formed at the bottom of recesses in the cylinder head. The intake and exhaust pipes are then advantageously positioned in the direction of the flow of gas. To improve the flow pattern, the end face of the piston may be recessed and have a part spherical cavity.

A stroke/bore ratio of about 0.9 can in this way be obtained without difficulty. Since scavenging takes place with the piston near the lowest dead centre, when the piston is far from the valves, the valves may have a considerable opening stroke so that a high "permeability" is obtained; moreover, this permeability increases with the angle of inclination of the valves. With four valves arranged at 45° in a roof-shaped cylinder head, a stroke/bore ratio of 0.9 and a useful stroke amounting to 0.8 time the total stroke, the cross-sectional area available for the passage of the scavenging air and gases is substantially equivalent to that which can be obtained with "scavenging from below" through cylinder ports in an engine having a stroke/bore ratio of 1.2 and a working stroke amounting to 0.62 time the total stroke. The cross-sectional area will however be smaller than that available for "unicurrent" scavenging through ports and valves. This limitation is acceptable when a supercharging system enables very high levels of supercharging to be obtained, as will be explained hereinafter, and/or when the valves are provided with a fast action operating mechanism. Then, the reduction in the volumetric filling coefficient is balanced by the fact that a higher air pressure is established in the cylinders and/or the time during which the valves are partially opened is decreased.

The invention enables a conventional four-stroke engine to be converted into a supercharged two-stroke engine with a substantial power increase. All that is necessary is to change the cylinder head, the valves and the distributor mechanism and to machine the pistons. This type of conversion is of particular interest in the case of a "super-square" four-stroke engine.

It has already been proposed to maintain a moderate pressure in the crank case of a piston engine. The advantage of such a pressure is quite limited, even if different surfaces are subjected to the pressures in the combustion chamber and the crank case (German Pat. No. 737,206).

According to another aspect of the invention, there is provided a super-charged two-stroke engine, in particular a Diesel engine, comprising at least one cylinder and at least one piston reciprocably moving therein, the piston and cylinder together forming a combustion chamber of variable volume, in which engine the piston and crank case together delimit a compartment which is substantially gas tight and the volume of which does not substantially change, means being provided to maintain a pressure amounting to between one quater and one half the pressure produced in the combustion chamber in the course of one operating cycle when the engine is under full load in said compartment when the engine is running.

This pressurization of the crank case eases the load on the moving connecting parts and enables the engine to tolerate very high combustion pressures, amounting to about twice the pressure which could be accepted in a conventional Diesel engine (pressure of the order of 250 bar). By this means, it is possible to derive the maximum possible benefit from the supercharging pressures obtainable with the supercharging system to be described hereinafter, and to increase proportionately the power developed by the engine.

Pressurization of the crank case is more easily achieved in an engine with valves of the kind defined above, mainly because such an engine has a much smaller crank case than a conventional supercharged two-stroke engine and—for a given internal pressure—the wall thickness of the case increases in proportion to its diameter. At given thickness, therefore, much higher pressures can be sustained in a smaller crank case such as the one used in a two-stroke engine which is super-square. For similar reasons, this arrangement eliminates the excessive consumption of oil, which would otherwise be carried out through the ports by the air flow.

In a two-stroke engine with conventional scavenging means, the ports constitute a zone of low pressure. Packing of the piston skirt with rings between the intake manifold and the crank case must be extremely efficient. If the case is pressurized at 75 bar, for example, the escape of air from the case through an effective cross-sectional area of 1 $mm^2$ represents a loss of power of 10 hp. In the case of a two-stroke engine with valves of the kind defined above, there is no such low pressure zone and sealing of the bottom of the piston skirt with packing rings is then not necessary. The leaks from the crank case towards the combustion chamber when the piston is close to the lower dead centre is more or less balanced by leaks from the chamber towards the crank case when the piston is close to the upper dead centre.

The invention will be better understood from a consideration of the following description of a supercharged two-stroke engine which constitutes a particular embodiment of the invention given by way of non-limiting example. The description refers to the accompanying drawings.

SHORT DESCRIPTION OF THE DRAWINGS

DESCRIPTION OF PREFERRED EMBODIMENTS

Figure 1:
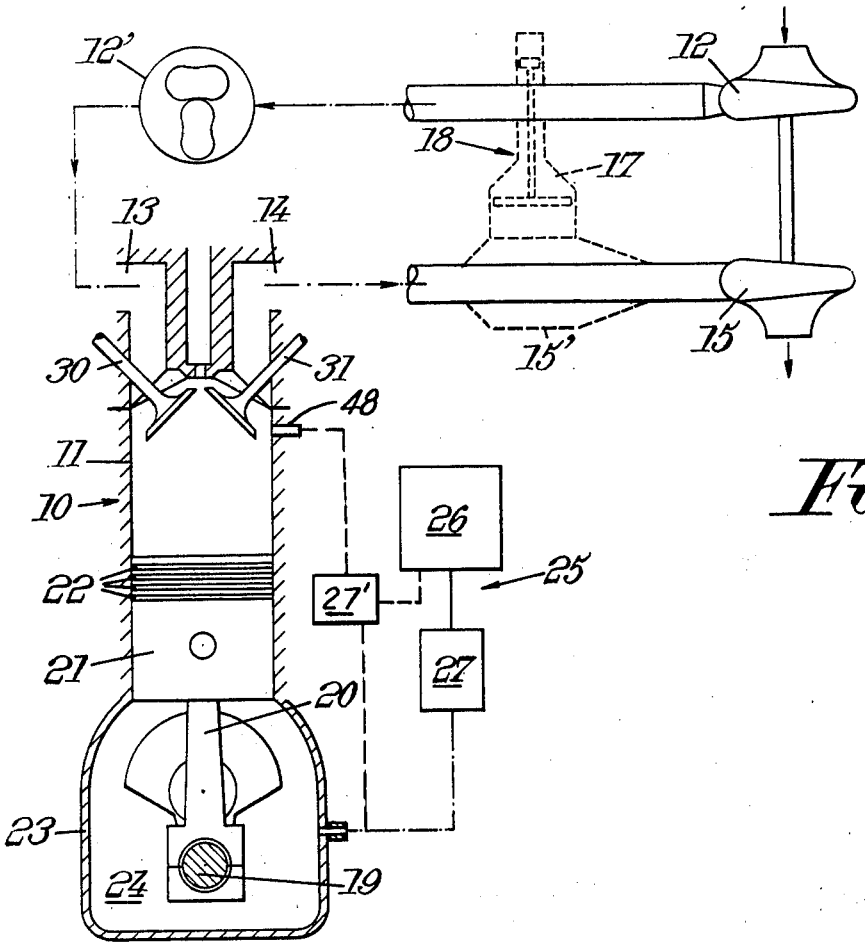
FIG. 1 is an overall diagram showing the main parts of the engine.

As indicated above, the invention can be applied to any supercharged two-stroke engine but is of particular advantage if the supercharging pressure is high. Referring to FIG. 1, there is shown a prime mover comprising a Diesel engine 10 (only one cylinder of which has been shown) and a supercharging system comprising, on the one hand, a compressor 12 with a high pressure ratio driven by a turbine 15 which is actuated by the exhaust gases from the engine; and, on the other hand, a compressor 12' drivably connected to the engine (a ROOTES compressor in FIG. 1) and located between the air outlet of the turbocompressor and the intake manifold 13 of the engine.

Instead of a supercharging device arranged in series with the engine, there may be provided a supercharging device arranged in parallel flow relation with the engine and having a by-pass duct 17 which circulates, from the compressor 12 to the turbine 15, that air delivered by the compressor which is not drawn by the engine with a pressure drop between compressor; and turbine, which—if appreciable—is substantially independent of the rate of flow through said by-pass and increases with the outlet pressure of the compressor such a construction removes the risk of compressor surge. The pipe 17 may be provided with a pressure drop device 18 similar to one of those described and claimed in my U.S. Pat. No. 3,988,894, in order to maintain a pressure difference between the intake and exhaust of the engine 10 sufficient to ensure scavenging without risk of compressor surge.

The supercharging device may also comprise an auxiliary combustion chamber 15'. In that case, the turbine-compressor unit may operate autonomously, independently of the engine 10, and the scavenging blower, i.e. the compressor 12', may then be omitted.

When using a single turbocompressor unit having several stages, of the type currently available for aeronautic purposes and having a high elementary polyentropic efficiency of compression and expansion, exceeding 80%, it is possible to obtain a supercharging pressure of as much as 14 bars with a temperature at the turbine inlet not exceeding 600° C. when the atmospheric temperature is 15° C. A double compressor with cooling between the compressor bodies may also be used.

The engine 10 has a conventional crank shaft, each crank 19 of which is attached to the piston rod 20 of a piston 21 which reciprocates in one of the cylinders 11. The piston 21 has piston rings 22. The pistons 21, cylinders 11 and crank cases 23 cooperate to define a compartment 24. The engine shown in the drawing has a pressurisation device 25 for the crank case compartment 24. Device 25 may be very simple in construction and may consist merely of a compressor 26, for instance driven by the engine, which delivers air under an appropriate pressure to the crank case 23 through an automatic valve 27 which cuts off the supply of air or stops the compressor 26 when the set pressure has been reached in the gas tight compartment 24.

The compressor 26 for pressurizing the crank case 23 may be integrated in the engine. It may be a positive displacement compressor with pistons and may benefit from the lubricating and cooling systems of the engine. The compressor 26 may be a single stage compressor or a multi-stage compressor with intermediate cooling. The moving parts driving the piston or pistons of compressor 26 may be operated by an additional crank of the crank shaft or by an eccentric which may be driven, for example, by a timing gear pinion of the engine.

The compressor is preferably supplied with air taken from the supercharging circuit, preferably downstream of a cooler for cooling the supercharging air (not shown in FIG. 1). The compression work performed by the compressor will thereby be reduced, as will also its compression ratio. Moreover, the piston or each piston of the pressurization compressor may be subjected on its lower face to the pressure prevailing in the compartment of the crank case. In that event, any air or oil lost by leakage over the packing rings will be completely recovered. Similarly, it will not be necessary to remove oil from the air compressed by the compressor, since the air will be fed into the engine crank case after it has been cooled. Lastly, cooling of this compressed air may be effected by immersion of the system of delivery pipes in that water which cools the engine jacket.

The pressurization device for the crank case enables a much higher volumetric ratio and maximum cycle pressure to be adopted for engine 10 than would be possible in an installation of the kind described in the U.S. patent mentioned above. The progress achieved will be obvious from the specific example given below.

An apparatus of the type described in the U.S. patent mentioned above may have the following characteristics:

| | |
|---|---|
| Volumetric ratio (engine compression ratio) | 4.7 |
| Mean indicated pressure (MPI) | 42 bars |
| Maximum pressure of cycle | 135 bars |
| Exhaust temperature | 600° C. |
| Outlet pressure of compressor | 14 bars (atmosphere:1013 mbars) |
| Intake temperature of the engine | 160° C. |

-continued

| | |
|---|---|
| Pressure drop between compressor and turbine | 15% |

It is known that the thermodynamic efficiency of a Diesel engine increases with its volumetric ratio.

It may be thought that it is advisable to design an engine with a higher volumetric ratio while keeping the supercharging pressure the same. If, for example, a volumetric ratio of 7.5 is chosen, calculation shows that the figures given for the above engine become:

| | |
|---|---|
| Mean pressure indicated (MPI) | 63 bars |
| Maximum pressure of cycle | 250 bars |
| Engine intake temperature | 100° C. |
| Engine exhaust temperature | 600° C. |

The power developed during such a working cycle is almost 50% higher than that of the previous cycle and the specific consumption is reduced by about one quater while the thermal level of the engine is practically unchanged.

However, anybody skilled in the art of Diesel engines will appreciate that it is out of the question to reach a maximum cycle pressure of 250 bars since this causes unacceptable mechanical stresses in the moving parts (piston, rod and crank shaft).

According to a first aspect of the invention, the problem is overcome by establishing a suitable pressure in the crank case, which pressure is much higher than atmospheric pressure and the pressures reached in conventional two-stroke engines with precompression in the crank case.

The selected level of pressure in the crank case is a compromise solution which enables much the same level of maximum stress to be maintained under all operating conditions (engine at rest while the crank case is under pressure, engine decelerating, acceleration of idling engine, engine at full power) and at every stage of the operating cycle (in particular at the upper and lower dead centres). In practice, one would generally select a crank case pressure between one quarter and one half the maximum pressure reached in the combustion chamber when the engine is under full load.

This solution is applicable only to two-stroke engines. In a four-stroke engine which has an intermediate upper dead centre (at the end of exhaust and beginning of intake) the combination of the inertia forces and the thrust of air under pressure in the crank case would cause a tractive force on the piston or connecting rod and the cap of the connecting rod end which is excessive during acceleration of the unloaded engine.

In practice, it will frequently be necessary to choose a crank case pressure amounting to about one third of the maximum pressure in the combustion chamber at full power, that is to say the pressure reached when the piston is at the upper dead centre.

An acceptable value will be arrived at in this way, for example with a pressure of 75 bars in the crank case. With an engine having a 135 mm bore and a 122 mm stroke, the maximum tractive force on the cap of the connecting rod end will be 9T (when the engine is at rest and the crank case under pressure or, during acceleration in neutral gear, at the upper dead centre) and the compression stress will be 15T (at the upper dead centre at full power).

In the case of a four-stroke cycle, on the other hand, the traction on the connecting rod at the upper dead centre during acceleration in neutral gear would be 20T, which is excessive.

Since the tractive force transmitted by the connecting rod is always greater than in a conventional engine, it will generally be necessary to use a reinforced connecting rod end.

There is a considerable attendant advantage in keeping the crank case under pressure: lubrication of the small end of the connecting rod is improved. In a conventional two-stroke engine, the rod permanently operates under compression. The piston 21 therefore permanently bears against its axis and it is difficult to lubricate the small end 29 of the connecting rod since the oil film tends to be destroyed by the pressure and cannot build again. If, on the other hand, the chamber 24 of the case 23 is under an air pressure, the base of the rod is subjected alternately to traction and compression. A fresh film is therefore formed easily. This, to a large extent, eliminates the risk of destruction of the bearing ring of the small end of the connecting rod.

Figure 2:
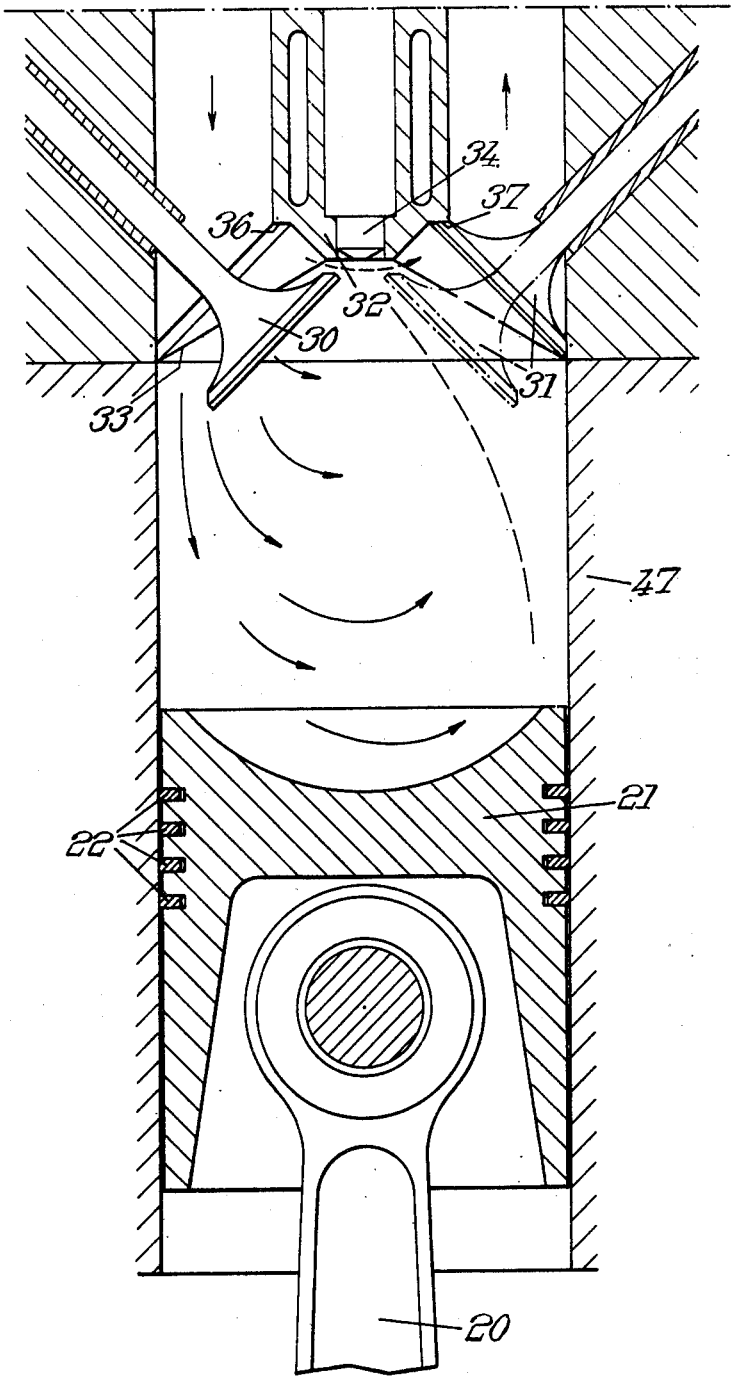
FIG. 2 is a diagrammatic section on an enlarged scale taken along the axis of the cylinder of the engine shown in FIG. 1.

Referring to FIGS. 1 and 2, there is shown an engine having one intake valve 30 and one exhaust valve 31 (this number is not limiting) placed in the cylinder head opposite the piston 21. Such an engine may briefly be described as "scavenged from the top".

As already indicated above, the valves 30 and preferably 31 as well as the piston 21 should be designed to ensure as far as possible that scavenging takes place along a path which may appropriately be named "along a loop" throughout the entire combustion chamber and limiting direct flow of air from the intake valve(s) toward the exhaust valve(s).

In the embodiment illustrated in FIGS. 1 and 2, the wall 33 of the cylinder head is designed for cooperating in achieving that result.

It will be first assumed that two valves are associated with each cylinder. The valves 30 and 31 are placed symmetrically at an angle of 45° to the axis of the cylinder, on one and the other side of the fuel injector 34. The valve seats 36 and 37 are placed at the bottom of cylindrical recesses formed coaxially with the valves in the wall 33 of the cylinder head 32. The depth of the recesses increases steadily from the periphery of the combustion chamber toward the axis thereof. The angle between the two lines of the axial cross-section drawn from the central portion of the cylinder head wall (which constitutes a baffle or gas deflector) and the radially outer portions of respective valve seats is about 120°.

At the beginning of the lifting movement of the intake valve, air begins to enter the combustion chamber along the wall of the chamber formed in the cylinder block since any stream of air which would tend to by-pass the chamber are held back due to the small value of the clearance between the periphery of the valve head and the wall of the cylindrical recess. It is only when the intake valve 30 is fully open (position shown in FIG. 2) that a small amount of air passes round the upper part of the valve head to complete the filling of the cylinder and scavenge the zone adjacent to the injector 34.

The exhaust valve 31 (shown in dash-dot lines in fully open condition) has a similar effect on the gases flowing out of the chamber. The effect is enhanced when the air intake pipe and exhaust pipe are arranged for directing the gases parallel to the cylinder axis, at least in the "control" portion thereof, which is generally the portion of smallest cross-sectional area close to the opening into the chamber.

This arrangement further keeps the zone confronting the injector 34 at a higher temperature because this zone is hardly scavenged, a condition which is favourable for rapid combustion of the fuel.

Figure 3:
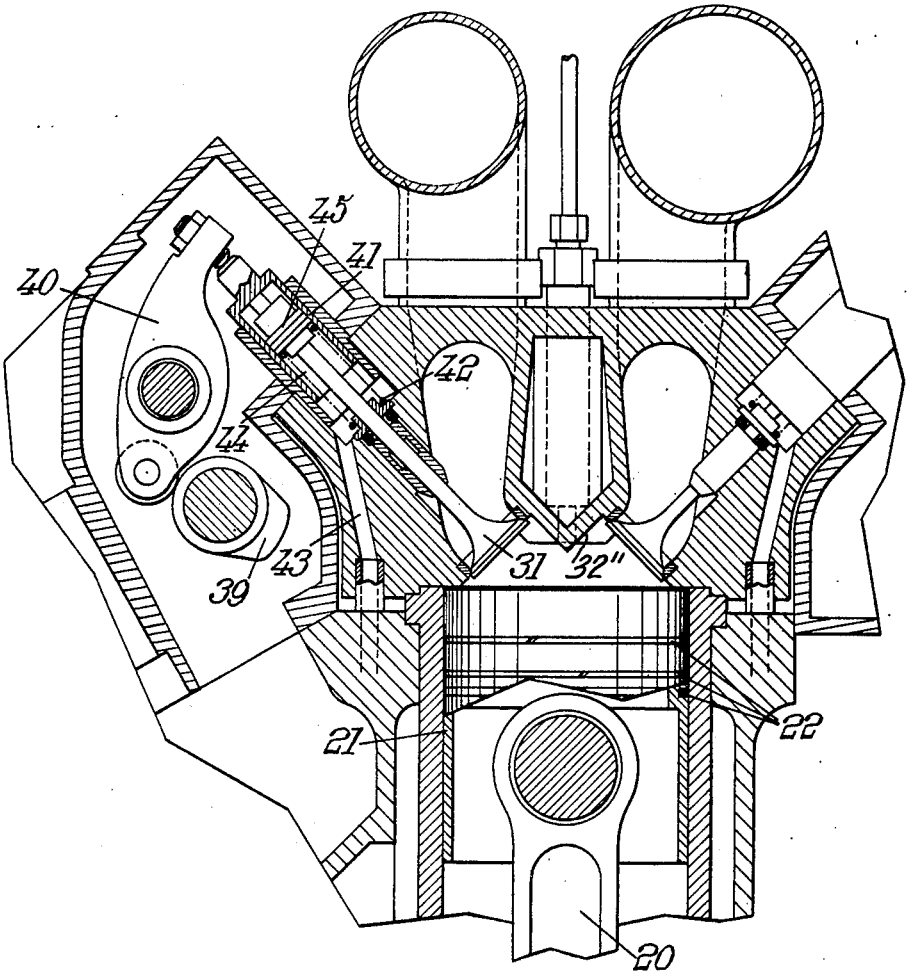
FIG. 3 represents schematically a possible arrangement for controlling the valves of the engine of FIGS. 1 and 2.

The two-valve arrangement described above is not the only one possible. Satisfactory results are obtained with any arrangement by which the lower portion of the valve is cleared from the cylinder head 32 first during the opening movement. This produces a form of sheet-wise scavenging, an effect which is even stronger if two or more valves are used in parallel. In that case, the projection of the deflection located between the valves may be increased, as shown at 32' in dash-dot lines in FIGS. 4 and 5 or as shown in solid lines at 32" in FIG. 3. Then the salient parts of the cylinder head wall are along a roof-shaped rather than conical surface. An arrangement comprising four valves in a roof-shaped cylinder head will generally provide more "permeability" than two valves and leaves more room for the injector.

Figure 4:
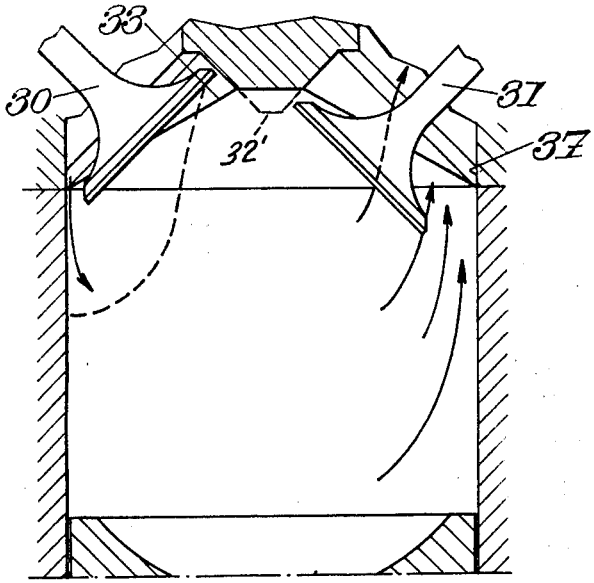
FIGS. 4 and 5 are sketches illustrating the flow of gases in the cylinder of FIG. 2 upon opening of the intake valve or valves.
Figure 5:
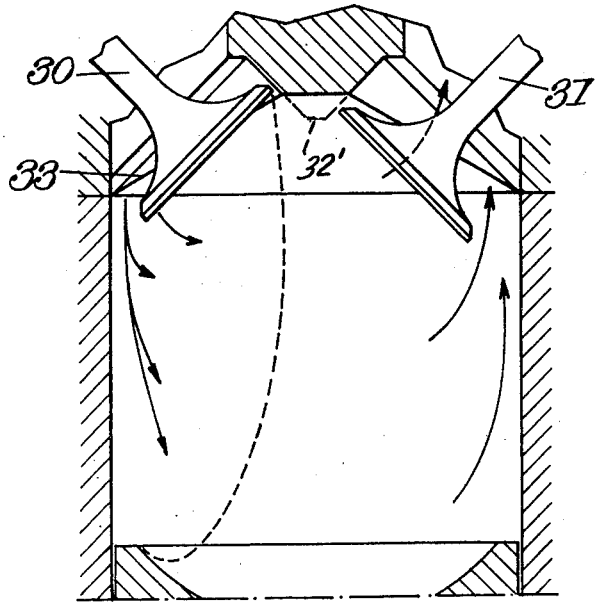

For an easier understanding of how scavenging occurs, the general direction of gas flow and the front of the air "slug" admitted into the combustion chamber have been indicated on FIGS. 2, 4 and 5 with arrows and with a dash line, respectively. Such indications are approximative only.

Referring to FIG. 4, when the intake valves 30 are only slightly open, air flows into the combustion chamber along the cylinder wall, around the small portion of the periphery of the head of valve 30 which is clear from the recess.

Upon continued opening of valve 30 (FIG. 5), air flows across an increased cross-sectional area, but remains directed toward the bottom of the chamber. Air flow around the part of the valve head located in the deepest part of the recess is restrained by the head loss impressed by the low value of the radial clearance. Typically, that clearance will be between 1% and 10% of the valve head diameter. A clearance of from 1 to some millimeters will generally be satisfactory if the diameter is 40 mm.

When all valves are fully open (FIG. 2), a small flow of air circulates directly from the intake valves to the exhaust valves to complete scavenging.

In a four-stroke engine, the burned gases are replaced by fresh air delivered through valves in the cylinder head during a rotation of the crank shaft through approximately 360°. The lifting and return of the valves may then be sufficiently slow for the valves to be actuated by mechanical means such as cams, tappets and rocker arms for the lifting movement and springs for the return movement.

In a two-stroke engine, scavenging of the burned gases by the fresh air must be completed within one half to one third of the time allowable in a four-stroke engine. This reduction in the scavenging time is generally compensated by an increased cross-sectional area of the ports provided for the gas and air. This is achieved by providing intake ports distributed over the whole periphery of the bottom of the cylinder and four exhaust valves in the cylinder head in the case of "unicurrent" scavenging arrangement. If intake and exhaust ports are used, the cross-sectional area of the ports is increased by increasing the length of the piston stroke (to the detriment of the specific power). In a device as described above, where only valves are provided for intake and exhaust across the cylinder head, the cross-section available for the passage of gas and air cannot be substantially increased. It is therefore necessary to shorten as much as possible the time required for opening and closing of the valves so as to obtain the steepest possible opening diagram.

As a consequence, the lifting time will be shortened by using a cam with a steep profile. The moving parts comprising the cam 39, tappet 41 and rocker arm 40 will be strenghtened. However, the weight of the moving parts need be kept as low as possible for reducing the inertia. For this reason, a cylinder head with four valves will be preferable to one with two valves.

If return of the valves were by a spring alone, mechanical and bulk considerations would limit the acceleration which can be imposed to the valve on the return movement. For rapid return of the valve, the action of springs 42 is assisted or replaced by the action of a fluid under pressure. That fluid is typically a gas, which has much less inertia than a liquid. It will be advisable to utilize the pressure in the crank case by connecting the pressurized crank case by a pipe 43 to a chamber 44 in which a piston is slidable, which piston is connected to the tail end of the valve and may further be used as tappet or push rod.

Pressurization of the crank case 23 requires some design modifications. The output of the engine shaft through the casing must be rendered gas tight to prevent leakage of oil under pressure.

A combination of the arrangements described above provides advantages additional to those inherent in each arrangement. In particular, scavenging with intake and exhaust valves cures the problems which would stem from the pressurization of the crank case 23 associated with "unicurrent" scavenging or scavenging by means of ports. The risk of damage to the leading piston rings by the ports is eliminated since the differential pressure applied to them is reduced. The differential pressure reverses in the course of a cycle, with the result that the oil consumption and leakage of gas from the crank case to the combustion chamber are reduced.

The invention allows for numerous variations. In particular (but not exclusively), the valves may be set at an angle other than 45°, which incidentally results in a shape of the cylinder head wall different from that described above. Instead of being subjected to a fixed pressure, the crank case may be subjected to a pressure controlled in dependence upon the operating conditions of the engine according to a predetermined law of variation: this can be achieved by replacing the calibrated valve 27 by a servo-mechanism 27' associated with a pressure pick-up 48 which senses the maximum pressure in the cylinder 10 during a cycle (as indicated schematically in FIG. 1). It should be understood that the scope of the present patent extends to any modification within the skill of the man of the art.

I claim:

1. A supercharged two stroke internal combustion engine, having:

a cylinder block and a cylinder head cooperating with at least one piston reciprocably received in a cylinder formed in said cylinder block to define at least one expansible combustion chamber, at least one intake valve slidably received in said cylinder head and cooperating with an intake valve seat to control air flow from an intake pipe into said chamber, at least one exhaust valve slidably received in said cylinder head and cooperating with an exhaust valve seat to control gas flow from said combustion chamber to an exhaust pipe, and means for operating said intake and exhaust valves in proper time sequence with the displacement of said piston, whereby both said valves are open while the piston is at its bottom dead center, said intake valve, intake pipe and cylinder head being so arranged and constructed to cause a progressively increasing non-uniform intake clearance opening oriented such that in response to opening movement of the said intake valve, the largest intake orifice area is developed at least initially closest to that portion of the wall of said cylinder must remote from said exhaust valve seat, so as to cause air to be directed toward the piston and substantially parallel to the wall of said cylinder upon opening of the intake valve and to thereby sheet-wise scavenge the chamber along a loop therein without substantial direct flow of air from the intake pipe to the exhaust pipe along the cylinder head.

2. An engine according to claim 1, wherein said intake pipe is directed substantially parallel to the direction of movement of the piston, at least in a portion thereof close to the seat of said intake valve and long enough to impress a direction of flow to the air admitted into the chamber oriented to reinforce said sheet-wise scavenging of the chamber.

3. A supercharged two stroke internal combustion engine, having:

a cylinder block and a cylinder head cooperating with at least one piston reciprocably received in a cylinder formed in said cylinder block to define at least one expansible combustion chamber, at least one intake valve slidably received in said cylinder head and cooperating with an intake valve seat to control air flow from an intake pipe into said chamber, at least one exhaust valve slidably received in said cylinder head and cooperating with an exhaust valve seat to control gas flow from said combustion chamber to an exhaust pipe, and means for operating said intake and exhaust valves in proper time sequence with the displacement of said piston, whereby both said valves are open while the piston is at its bottom dead center, said cylinder head being formed with a deflection surface between said intake valve and exhaust valve for substantially preventing direct flow of air from the intake pipe to the exhaust pipe upon simultaneous opening of both valves and for directing the airflow admitted around said intake valve toward the piston along the cylinder wall so as to sheet-wise scavenge the combustion chamber along a loop therein.

4. An engine according to claim 1, wherein the direction of reciprocation of said intake valve at least is at a substantial angle with respect to the direction of movement of said piston and wherein said cylinder head is formed with a deflecting member located between the intake and exhaust valves.

5. An engine according to claim 4, wherein the intake and exhaust valves are located symetrically with respect to a mid plane of the combustion chamber and at an angle of about 45° with respect thereto.

6. An engine according to claim 1, wherein the seat of at least said intake valve is formed at the bottom of a recess provided in the cylinder head, said recess having a depth which is substantially zero in the portion thereof closest to the cylinder wall and which is maximum in the portion thereof closest to the axis of said cylinder and wherein the dimensions of said recess and the diameter of the valve disc are so proportioned that a small clearance only exists between the disc and the recess wall.

7. An engine according to claim 1, wherein said cylinder block and said cylinder head are arranged to include a plurality of said one piston and associated cylinder and expansible combustion chamber to thereby define a multi-cylinder engine, and further comprising a casing cooperating with said pistons to define a compartment of substantially constant volume, having means for maintaining said compartment at a gas pressure comprised between one fourth and one half of the maximum pressure in each said combustion chamber under full load of the engine, at least when said engine is operating under full load.

8. An engine according to claim 7, wherein the means for operating one at least of said valves comprises mechanical means for exerting an opening action on the stem of said valve against the action of return means, said return means having a piston secured to said valve stem and slidably received in a bore of said cylinder head, limiting in said bore a chamber communicating with said compartment to thereby effect gas pressure closing action of said one valve.

9. An engine according to claim 1, wherein the means for operating one at least of said valves comprises mechanical means for exerting an opening action on the stem of said valve against the action of return means, said return means having a piston secured to said valve stem and slidably received in a bore of said cylinder head and means for maintaining in said bore a gas pressure sufficient for closing said valve.

10. A supercharged two-stroke multi-cylinder Diesel engine having a plurality of cylinders, at least one piston reciprocable in each cylinder and delimiting with the associated cylinder an expansible combustion chamber, a crankcase cooperating with said pistons to delimit a substantially gas tight compartment, and means which, during running of the engine under full load, maintains said compartment charged with a gas at a pressure between one quarter and one half the pressure reached in each combustion chamber when the engine is running under full load.

11. Engine according to claim 10, wherein said pressure maintaining means is operable to maintain the gas pressure in the compartment at a fixed value.

12. Engine according to claim 10, wherein said pressure maintaining means is operable to adjust the gas pressure in the compartment as a function of an operating parameter of the engine.

13. Engine according to claim 10, having intake and exhaust valves, and wherein closure movement of the valves is under the pressure force of compressed gas occupying the compartment.

14. Engine according to claim 10, wherein said pressure maintaining means is operable such that the gas pressure in said compartment is controlled to cause the piston rod to be alternately subjected to compression and tensile forces during a working cycle.

* * * * *

UNITED STATES PATENT AND TRADEMARK OFFICE

CERTIFICATE OF CORRECTION

PATENT NO. : 4,162,662

DATED : July 31, 1979

INVENTOR(S) : Jean Melchior

It is certified that error appears in the above-identified patent and that said Letters Patent are hereby corrected as shown below:

Column 4, line 53, after "compressor" delete the semi-colon (;)

Column 10, line 15, after "cylinder" change "must" to -- most --

Signed and Sealed this

*Fourth* Day of *December 1979*

[SEAL]

*Attest:*

SIDNEY A. DIAMOND

*Attesting Officer*

*Commissioner of Patents and Trademarks*